US009428958B1

(12) United States Patent
Ellis

(10) Patent No.: US 9,428,958 B1
(45) Date of Patent: Aug. 30, 2016

(54) LADDER TRAY

(71) Applicant: Timothy S Ellis, Lombard, IL (US)

(72) Inventor: Timothy S Ellis, Lombard, IL (US)

( * ) Notice: Subject to any disclaimer, the term of this patent is extended or adjusted under 35 U.S.C. 154(b) by 0 days.

(21) Appl. No.: 14/310,917

(22) Filed: Jun. 20, 2014

(51) Int. Cl.
*E06C 7/14* (2006.01)
*E06C 7/16* (2006.01)
*B25H 3/06* (2006.01)

(52) U.S. Cl.
CPC . *E06C 7/14* (2013.01); *E06C 7/16* (2013.01); *B25H 3/06* (2013.01)

(58) Field of Classification Search
CPC ..... B25H 3/06; E06C 7/14; E06C 7/16; E04G 11/20
USPC ..... 182/129; 248/210, 238
See application file for complete search history.

(56) References Cited

U.S. PATENT DOCUMENTS 2,308,180 A * 1/1943 Larsen ..... E06C 7/14 182/129
4,261,435 A 4/1981 Winter
4,730,802 A * 3/1988 Chatham ..... B25H 3/06 182/129
5,079,795 A * 1/1992 Schmid ..... B44D 3/126 15/257.06
5,275,256 A * 1/1994 Ellzey ..... E06C 7/14 104/246
5,342,008 A * 8/1994 Kay ..... E06C 7/14 182/129
5,370,263 A * 12/1994 Brown ..... E06C 7/14 206/373
D363,995 S 11/1995 Mollenhauer
5,622,278 A * 4/1997 Fries ..... E06C 7/14 206/373
5,772,358 A * 6/1998 Takahashi ..... E02D 29/12 182/90
5,782,314 A * 7/1998 Zeitler ..... E06C 7/14 182/129
5,901,998 A * 5/1999 Gallo, Jr. ..... E06C 7/14 182/129
5,957,238 A * 9/1999 Curvin, II ..... E06C 7/146 182/129
6,131,699 A * 10/2000 Leak, Jr. ..... E06C 7/14 182/129
6,334,509 B1 * 1/2002 Ryszkiewicz ..... E06C 7/14 182/129
6,401,862 B1 6/2002 Caron
6,443,260 B1 9/2002 Katz et al.
6,824,115 B1 * 11/2004 Batson ..... E06C 7/143 182/129
6,862,755 B1 * 3/2005 Crachy ..... E04H 4/14 4/496
D541,432 S * 4/2007 Rapp ..... D25/68
8,925,683 B1 * 1/2015 Gunsaullus ..... B62B 3/005 182/129
8,925,684 B1 * 1/2015 Medina ..... E06C 7/14 182/115
2004/0163891 A1 * 8/2004 Craig ..... E06C 1/39 182/129
2004/0217241 A1 11/2004 Searcy
2006/0163003 A1 * 7/2006 Wigstrom ..... E06C 7/14 182/129
2009/0032662 A1 * 2/2009 Parrott ..... E06C 7/14 248/238
2012/0175329 A1 * 7/2012 Johnson ..... E06C 7/14 211/86.01
2014/0224703 A1 * 8/2014 Valenti ..... E06C 7/14 206/557

* cited by examiner

*Primary Examiner* — Daniel Cahn

(57) ABSTRACT

A removable ladder tray on a ladder having a base with a ladder opening formed therein. The ladder tray is attached and removed without tools. The ladder tray has an open containment area with a collared ladder opening for insertion of the ladder. The ladder opening is generally rectangular and formed adjacent the back of the tray. The ladder opening is surrounded by two spaced apart side edges and two spaced apart ladder leg edges forming a truncated pyramid shaped ladder box. The ladder tray press fits onto the ladder between the top of the ladder and the rungs. The ladder box surroundingly fits around the ladder holding the base top extending away from the user thereby allowing full use and access to the all the climbing rungs and the top platform on the ladder.

4 Claims, 3 Drawing Sheets

LADDER TRAY

BACKGROUND OF THE INVENTION

The present invention relates to a ladder-mounted tray for holding tools and materials needed for work while on the ladder. In the prior art, it is known to provide a ladder with a separate detachable tray that is mounted on the ladder in any one of a variety of ways. Some such devices rely upon the openings within the ladder's rungs to support the tray. Others rely upon the brackets or fasteners on the rungs or ladder head to support a tray. Still others rely upon the side rails of the ladder or combinations of the side rails, rungs and openings through rungs for support purposes. Generally, a user climbs to the upper end of the ladder to perform work. On a standard ladder there is nothing at the upper end of a ladder for carrying tools.

Many attempts have been made to provide some form of ladder tray for attachment to the upper end of the ladder for holding tools and materials. In particular, ladders may be ten or twenty feet long and relatively heavy. It is necessary for the user to position the ladder and climbed to the top to attach the ladder tray. Prior art devices require the user climbed to the top of the ladder and use fasteners or tools to attach a ladder tray. Further, the ladder tray may shield portions of the ladder, preventing full functionality to the user.

Accordingly, it is desirable to provide a ladder tray which may be attached to the top of the ladder without tools, while providing an interlocking fit to prevent the ladder tray from tipping. Further, it is desirable to provide a ladder tray which provides access to all of the rungs on the ladder including the top shelf on top of the ladder head.

SUMMARY OF THE INVENTION

The present invention relates to a ladder tray for use on a ladder. The ladder may have two front legs and two back legs. The front legs and back legs pivotally attached to each other at a ladder head. When deployed in a usable configuration the ladder head allows the front legs having climbing rungs thereon to pivot about the ladder head with respect to the back legs to form an a—frame shaped stand alone step ladder for a user. Generally, climbing rungs are disposed on the front legs. The present invention, in a first embodiment comprises a removable ladder tray on the ladder having a base with a ladder opening formed therein. The ladder opening is generally rectangular and disposed adjacent the back of the tray. The ladder opening has two spaced apart side edges and two spaced apart ladder leg sides. The edges of the smaller sides may bear against the outside of the respective ladder legs. The ladder tray comprises a base having a top defining an open containment area with a surrounding raised edge to prevent items from falling off the tray. The ladder is inserted into the ladder opening having the ladder head above the tray and the climbing rungs below the tray. The ladder opening surroundingly fits around the ladder adjacent to and just below the ladder head thereby allowing full use and access to the all the climbing rungs and the top step located on top of the ladder head. A ladder box surrounds the ladder opening on the tray having obliquely angled front and back walls to fit flush against the ladder legs. The ladder box acts as a collar to engage the ladder and provide support for the ladder tray. The raised edge may surround the containment area and the ladder box.

The ladder box comprises interconnected walls surrounding the ladder opening. The ladder box has a top and a bottom, the bottom is of similar size and shape as the ladder opening, the top is of similar shape as the bottom but may be smaller to snugly fit over the A-shaped step ladder. The ladder box may have two spaced apart vertical walls on the side edges of the ladder opening adapted to bear against the respective sides of ladder. The ladder box further has an obliquely angled support wall and an obliquely angled back wall. The support wall may comprise a bottom on the base and a top adapted to engage and bear against the back legs, the back wall may be art of the raised edge and is adapted to bear against the front legs below the ladder head. The back wall on the periphery edge provides a low profile on the front legs to minimize interference with the user standing on the rungs. The ladder head extends through the ladder box to provide access to the user.

Work items such as tools, paint, glue, etc. may be placed on the base causing the tray to pivot slightly about the connection point to the ladder. This pivoting motion may cause the top of the back wall to move upward towards the ladder head thereby engaging and bearing against the ladder head to hold the ladder tray in place. The sleeve like fitting of the ladder box around the ladder legs supports the tray in a generally horizontal position.

The foregoing is a description of a preferred embodiment of the invention which is given here by way of example only. The invention is not to be taken as limited to any of the specific features as described, but comprehends all such variations thereof as come within the scope of the appended claims.

SPECIFICATION OF THE INVENTION

Figure 1:
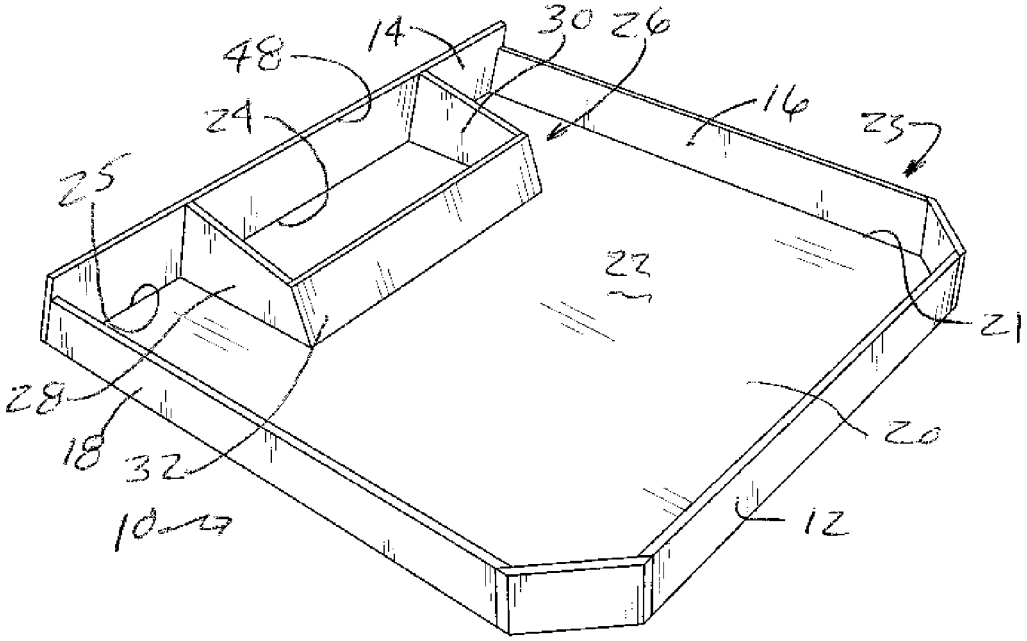
FIG. 1. is a top perspective view of a ladder tray showing a first embodiment.

Referring to FIG. 1, the removable ladder tray 10 may comprise a front wall 12, brace 14 and a first side wall 16 and second side wall 18. Front wall 12 is generally perpendicular to base 20. Brace 14 is obliquely attached to base 20 and spaced from front wall 12. First sidewall 16 and second sidewall 18 are generally parallel to each other and spaced apart. Base 20 has a peripheral edge 21 surrounding a working surface 22 of the removable ladder tray 10. First sidewall 16 extends between front wall 12 and brace 14. Second sidewall 18 extends between front wall 12 and brace 14. Together, front wall 12, brace 14 and first and second sidewalls 16, 18 are attached to the periphery of base 20 and each other to form a continuous wall 23 surrounding the base top 22.

Continuing to refer to FIG. 1, a ladder opening 24 is formed by removing material to create a hole in base 20 adjacent back edge 25 of base 20. A ladder box 26 may be attached to the base top 22 forming a tapered surrounding around the ladder opening 24. The ladder box 26 comprises two box sidewalls 28, 30 attached to and extending upward from and generally perpendicular to base top 22, a support wall 32 obliquely connected to the base top 22 and the two box sidewalls 28, 30. The two box sidewalls 28, 30 may be attached to and extend from support wall 32 to attach to brace 14 to give ladder box 26 a generally tapering shape surrounding and extending above ladder opening 24.

Figure 2:
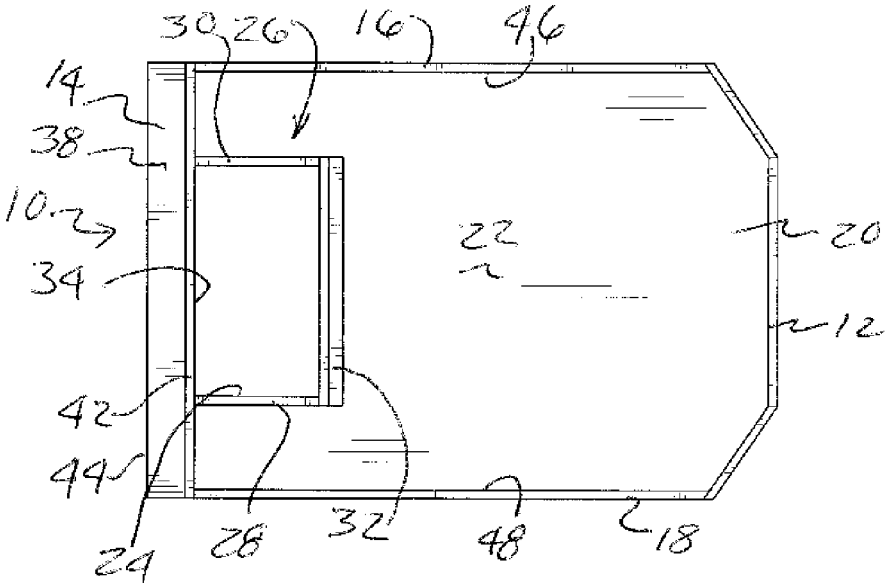
FIG. 2. is a top plan view of the first embodiment as shown in FIG. 1.

Referring to FIG. 2, the ladder box 26 further comprises a top opening 34 concentric with and smaller than ladder opening 24. Brace 14 further comprises an outside 38, a top 42 and a bottom 44. Brace top 42 may be disposed closer to the support wall 32 than bottom 44 thereby leaning brace 14 over ladder opening 24. Brace 14 may be obliquely attached to base top 22 and ladder box sidewalls 28, 30 which are joined by support wall 32 to surround ladder opening 24. First sidewall 16 and second sidewall 18 may further comprise an inside surface 46, 48, respectively, disposed in a generally perpendicular orientation to base top 22.

Figure 3:
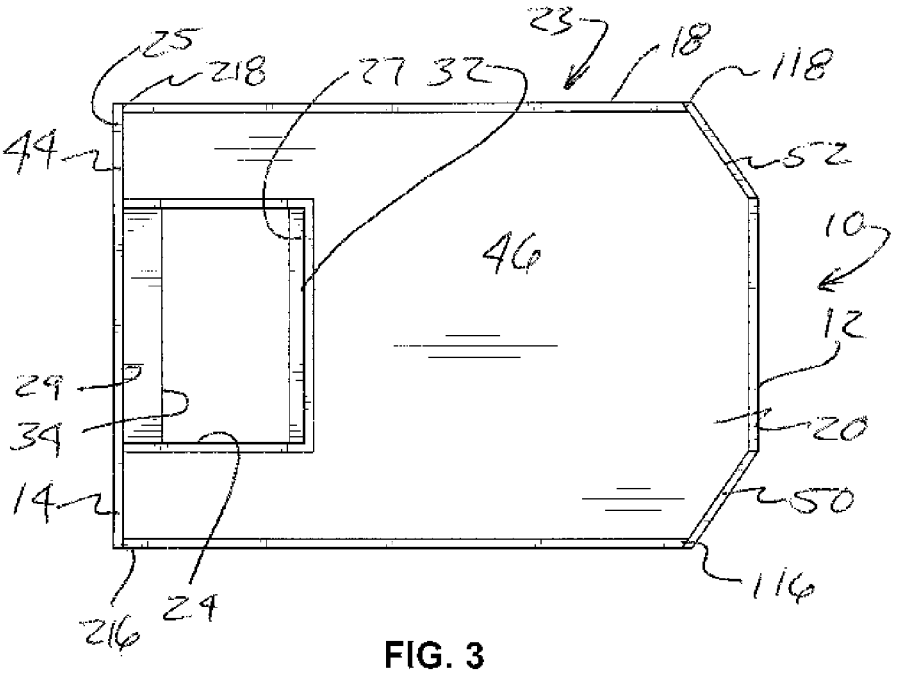
FIG. 3. is a bottom plan view of the first embodiment as shown in FIG. 1.

Referring to FIG. 3, the base 20 further comprises a bottom 46. The ladder opening 24 extends through the shelf 20 opening to the bottom 46. The ladder opening 24 has a leading edge 27 and a rung edge 29. The support wall 32 is attached to the base 20 adjacent the leading edge 27. Ladder opening rung edge 29 may open onto back edge 25 and be closed by brace 14. The support wall 32 and brace 14 are obliquely attached to the shelf 20 to form a ladder box top opening 34 smaller than the ladder opening 24. Front wall 12 may further be connected to the first sidewall 16 by first corner piece 50. Front wall 12 may be connected to second sidewall 18 by second corner piece 52. It should be understood, base 20 may be round, triangular or a different shape having surrounding wall 23 and ladder opening 24 disposed adjacent to back edge 25. Brace bottom 44 may be attached to back edge 25. In the preferred embodiment, and brace 14 is straight to fit flush against ladder (52, FIG. 7). Ladder box top opening 34 may have a size smaller than ladder opening 24 formed by brace 14 and support wall obliquely disposed on base 20. First sidewall 16 and second sidewall 18 may each be attached to base 20 each having a front end 116, 118, respectively, adjacent front wall 12 and a back end 216, 218, respectively, on brace 14.

Figure 4:
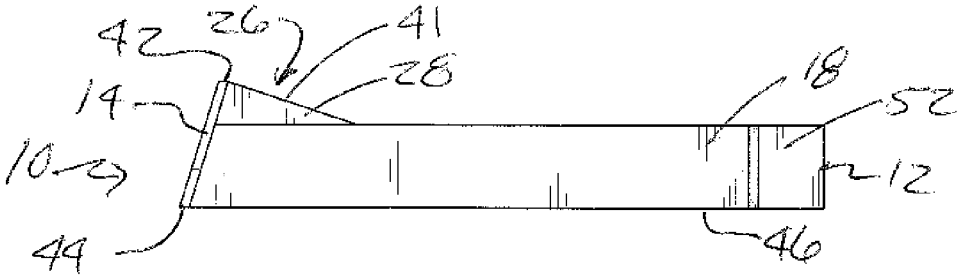
FIG. 4. is a left-side elevation view of the first embodiment as shown in FIG. 1, the right-side elevation view being a mirror image thereof.
Figure 5:
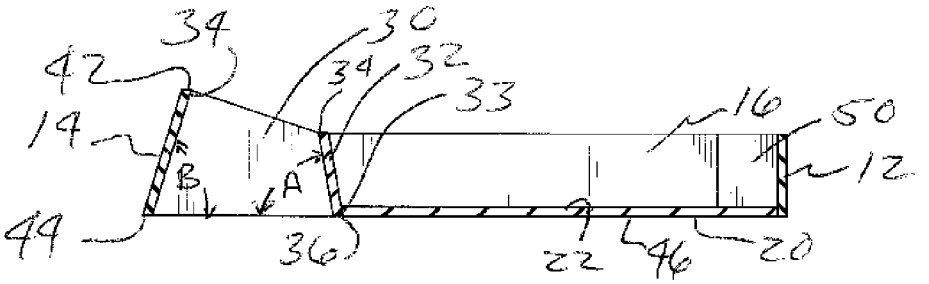
FIG. 5. is a section view of the first embodiment taken at approximately 5-5 of FIG. 2, FIG. 6. is a top perspective view of the first embodiment as shown in FIG. 1 separated from the ladder.

Referring to FIGS. 4 and 5, ladder box 24 may comprise a box bottom 33 on base 20 and a box top opening 34 spaced from the base 20. Brace 14 may be larger than front wall 12 extending further above base bottom 46. Support wall 32 is attached to base 20 at an oblique angle A to top 22. The support wall 32 further comprises a support top 34 and a support bottom 36. Support wall 32 is obliquely attached to base 20 having support top 34 disposed closer to brace 14 than support bottom 36 thereby leaning support wall 32 toward brace 14 and over ladder opening 24. Support wall 32 may extend to a similar height as first and second sidewalls 16, 18. First and the second ladder box sidewalls 28, 30 may have a trapezoidal shape along top edge to extend from base top 22 and connect support wall 32 and brace 14. As seen in FIG. 5, top edge 41 of first box sidewall 28 may be disposed at an acute angle to top 22 connecting support wall top 34 to brace top 42.

Figure 6:
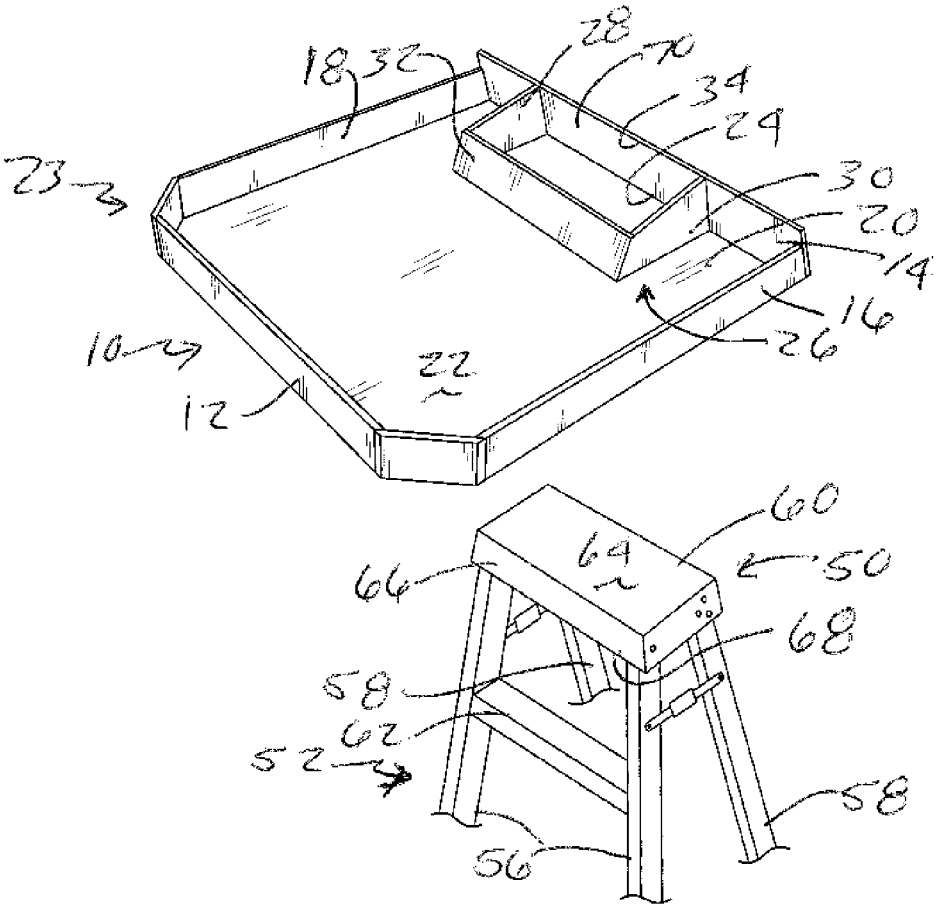

Referring to FIG. 6, the ladder tray 10 may be formed of metal or plastic. The ladder tray 10 may be formed of a single integrated molded material such as plastic molding or may be assembled by means such as welding or adhesives used to connect the base 20 to the surrounding edge 23 and the ladder box 26. The front wall 12, brace 14 and sidewalls 16, 18 may be attached to base 20 in an I-beam type configuration to provide more support, further additional beams (not shown) may be extended from the brace 14 to the front wall 12 for additional support. In addition, ladder box sidewalls 28, 30 may be extended between brace 14 and front wall 12. Ladder 52 comprises a pair of front legs 56 and one or more back legs 58. Front legs 56 may be joined by one or more climbing rungs 62 disposed between front legs 56. Front legs 56 may be fixedly attached to the ladder head 60. Ladder head 60 may be disposed at above rungs 62. Back legs 58 may be pivotally attached to ladder head 60 to allow the legs 56, 58 to pivot from a closed position (not shown) to an A-shaped, stand alone ladder 52. The ladder box 26 may surround ladder opening 24 having the obliquely disposed sides 70, 32 adapted to press fit securely on ladder 52 below ladder head 50 and above rungs 62. The ladder head 60 may further comprises a top step 64 and a front lip 66. Front lip 66 is attached to top step 64 and extends downwardly to bottom edge 68 spaced between top step 64 and rungs 62.

Figure 7:
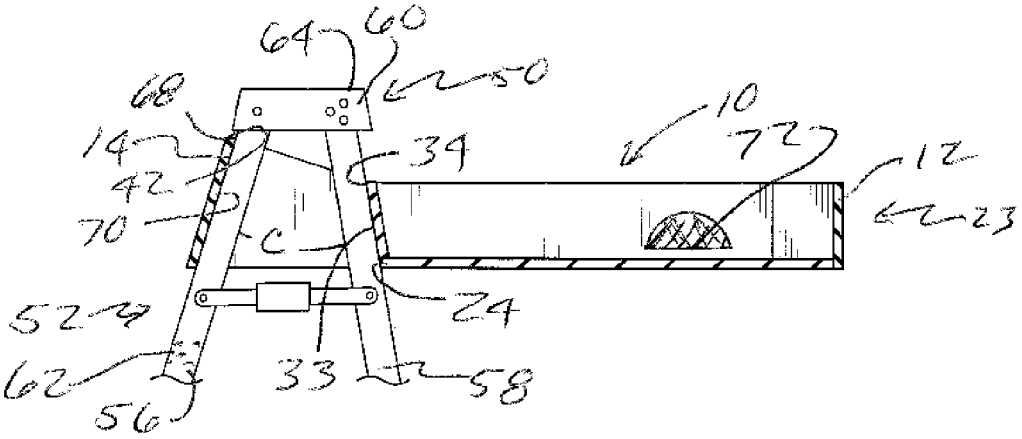
FIG. 7. is a side elevation view of the first embodiment in section mounted on the ladder.

Referring to FIG. 7, the ladder tray 10 may be removably attached to the ladder 52 by inserting ladder 52 in ladder opening 24 having ladder head 60 above base 20 and rungs 62 below base 20. In the preferred embodiment, front lip 66 is adjacent to and above brace top 42. Ladder surface 70 of brace 14 bears against front legs 56. Likewise, support wall 32 bears against support legs 58. Work material 72 on ladder tray 10 may cause the cantilever ladder tray 10 to pivot about the ladder box 26 on ladder 52 causing a canting of the ladder tray 10 with the front wall 12 dropping down and the brace 14 raising up causing the ladder tray 10 to shift from a normal, generally horizontal position, this canting may cause the brace top 42 to engage and bear against front lip bottom edge 68 thereby securing ladder tray 10 to ladder 52 without tools, clamps or fasteners.

Continuing to refer to FIG. 7, the brace 14 bears against the front legs 56 below the ladder head 50 and above the rungs 62. The oblique angle C between brace 14 and support wall 32 may be configured to closely match the angular relationship between front legs 56 and back legs 58 to allow the ladder surface 70 to be flush against front legs 56 and support wall to be flush against back legs 58 whereby the ladder box 26 is press-fitted over the top of the ladder 52. Ladder tray 10 attaches to ladder 52 without tools or fasteners. Ladder tray 10 is removed from the ladder 52 without tools. Ladder 52 may not have a head 50. Front legs 56 may be pivotally connected to back legs 58 above rungs 62. Ladder tray 10 is adapted by the oblique mounting of support wall 32 and brace 14 to bear against front legs 56 and back legs 58 to bind by friction holding ladder tray 10 to ladder 52. To remove ladder tray 10 from ladder 52 the back legs 58 are pivoted to a position adjacent front legs 56 to reduce the binding between ladder legs 56, 58 and ladder box 26.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

I claim:

1. In combination, a ladder having a ladder head, a plurality of front legs extending downwardly from the ladder head, a plurality of back legs extending downwardly from the ladder head, a climbing rung attached between the plurality of front legs, and a one-piece ladder tray removably attached on the ladder, the ladder tray comprising:

a planar base having a top with a top surface, a bottom with a bottom surface, a back edge and a peripheral edge;

a planar brace having a top, a bottom, a ladder surface extending from the brace bottom to the brace top, and the brace bottom located on the base back edge;

a ladder opening formed in the planar base and extending through the base top surface to the base bottom surface, the ladder opening adjacent to the brace, the front legs in the ladder opening while bearing against substantially an entire height of the ladder surface, the back legs in the ladder opening, the ladder tray between the ladder head and the climbing rung, the brace top bearing against the ladder head while the legs of the ladder extend through the ladder opening thereby disposing the removable ladder tray between the ladder head and the climbing rung; and wherein, when the combination is in use, a major plane defined by the planar base extends substantially parallel to a major plane of a top surface of the ladder head as the brace top is bearing against the ladder head, and when the combination is in use, the planar base is configured to hold and carry tools.

2. The combination of claim 1, further comprising a support wall on the base, the ladder opening further comprising a rung edge adjacent to the back edge and a leading edge spaced therefrom, the support wall on the base adjacent to the leading edge whereby the support wall bears against the back legs.

3. The combination of claim 2, further comprising a first box sidewall and a second box sidewall, each of the first and second box sidewalls attached to the base and the support wall, the first and second box sidewalls generally parallel and in spaced relation to each other, the first and second box sidewalls on the brace, the brace attached to the base at an oblique angle to form a ladder box in a generally tapering shape surrounding and extending above the ladder opening.

4. The combination of claim 3, further comprising a surrounding wall on the peripheral edge.

* * * * *